US010584838B2

(12) United States Patent
Deng

(10) Patent No.: US 10,584,838 B2
(45) Date of Patent: Mar. 10, 2020

(54) LIGHT

(71) Applicant: DONGGUAN PAN AMERICAN ELECTRONICS CO., LTD., DongGuan (CN)

(72) Inventor: Jinsheng Deng, DongGuan (CN)

(73) Assignee: DONGGUAN PAN AMERICAN ELECTRONICS CO., LTD., DongGuan (CN)

( * ) Notice: Subject to any disclaimer, the term of this patent is extended or adjusted under 35 U.S.C. 154(b) by 284 days.

(21) Appl. No.: 15/685,849

(22) Filed: Aug. 24, 2017

(65) Prior Publication Data

US 2018/0283628 A1 Oct. 4, 2018

(30) Foreign Application Priority Data

Mar. 28, 2017 (CN) ..... 2017 2 0316951 U

(51) Int. Cl.

| | |
|---|---|
| ***F21S 8/04*** | (2006.01) |
| ***F21S 8/00*** | (2006.01) |
| ***F21V 15/01*** | (2006.01) |
| ***F21S 8/06*** | (2006.01) |
| ***F21V 29/70*** | (2015.01) |
| ***F21V 31/00*** | (2006.01) |
| ***F21V 29/74*** | (2015.01) |
| ***F21V 17/10*** | (2006.01) |
| ***F21V 21/14*** | (2006.01) |

(Continued)

(52) U.S. Cl.

CPC ..... *F21S 8/04* (2013.01); *F21S 8/036* (2013.01); *F21S 8/043* (2013.01); *F21S 8/063* (2013.01); *F21V 15/01* (2013.01); *F21V 17/10* (2013.01); *F21V 21/14* (2013.01); *F21V 29/70* (2015.01); *F21V 29/74* (2015.01); *F21V 31/005* (2013.01); *F21V 19/0055* (2013.01); *F21W 2131/10* (2013.01)

(58) Field of Classification Search

CPC .... F21S 8/04; F21S 8/036; F21S 8/043; F21S 8/063; F21V 29/70; F21V 29/74; F21V 31/005

USPC ..... 362/408, 311.01, 368, 373

See application file for complete search history.

(56) References Cited

U.S. PATENT DOCUMENTS 8,272,765 B2 * 9/2012 Ter-Hovhannisyan ... F21S 8/03 362/294

2012/0087118 A1 * 4/2012 Bailey ..... F21V 31/005 362/235

(Continued)

*Primary Examiner* — Paultep Savusdiphol

(74) *Attorney, Agent, or Firm* — Platinum Intellectual Property LLP

(57) ABSTRACT

A light includes a bottom box, a cover mounted on the bottom box, a light emitting shield mounted on the cover and a back plate; the bottom box includes a bottom plate, a light source connected to the bottom plate, a sealing strip extending from the bottom plate, a plurality of cooling fins connected to the bottom plate and a rod sleeve connecting the bottom plate; the bottom plate is provided with a plurality of connection holes; the back plate includes a mounting portion, two extending portions extending from both sides of the mounting portion and two fixing portions extending from the extending portions; the mounting portion is provided with a rod receiving hole; the mounting portion is provided with a plurality of plate connection holes; the fixing portion of the back plate is provided with a plurality of fixing holes.

10 Claims, 4 Drawing Sheets

(51) Int. Cl.
*F21W 131/10* (2006.01)
*F21V 19/00* (2006.01)

(56) References Cited

U.S. PATENT DOCUMENTS

2012/0300454 A1* 11/2012 Ter-Hovhannisyan ... F21S 8/03
362/235
2014/0268729 A1* 9/2014 Boyer ..... F21V 21/14
362/227
2016/0003454 A1* 1/2016 Ye ..... F21V 27/02
362/268

* cited by examiner

LIGHT

CROSS REFERENCE TO RELATED APPLICATION

This application claims priority to Chinese Patent Application No. 201720316951.9, entitled "GAS STATION LIGHT" filed on Mar. 28, 2017 the content of which is expressly incorporated by reference herein in its entirety.

FIELD OF THE INVENTION

The present disclosure relates to lighting devices, and more particularly relates to a light.

BACKGROUND OF THE INVENTION

A light can be widely used, in addition to a gas station, it can also be applied in a supermarket and a workshop and other places. As the installation condition of a light is different in different applications, if the gas station only support a singular installation, the application of the light will be restricted, which is disadvantageous for the recycling of the light.

SUMMARY

Accordingly, the present disclosure provides a light that support multiple ways of installation.

A light includes a bottom box, a cover mounted on the bottom box, a light emitting shield mounted on the cover and a back plate; wherein the bottom box includes a bottom plate, a light source connected to the bottom plate, a sealing strip extending from the bottom plate, a plurality of cooling fins connected to the bottom plate and a rod sleeve connecting the bottom plate; wherein the bottom plate is provided with a plurality of connection holes thereon; the back plate includes a mounting portion, two extending portions extending from both sides of the mounting portion and two fixing portions extending from the extending portions; the mounting portion is provided with a rod receiving hole thereon; the mounting portion is provided with a plurality of plate connection holes thereon; the fixing portion of the back plate is provided with a plurality of fixing holes thereon.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

In order to make the above objects, features and advantages of the present disclosure become more apparent, the specific embodiments will be described in detail in combination with the accompanying drawings. Numerous specific details are described hereinafter in order to facilitate a thorough understanding of the present disclosure. The various embodiments of the disclosure may, however, be embodied in many different forms and should not be construed as limited to the specific embodiments set forth hereinafter, and people skilled in the art can make similar modifications without departing from the spirit of the present disclosure.

Unless otherwise defined, the technical and scientific terms used herein have the same meaning to the understanding of a person skilled in the art where the present disclosure pertains. The terms used in the specification of the present disclosure is for the purpose of describing the embodiments of the present disclosure, as opposed to limiting thereto.

Figure 1:
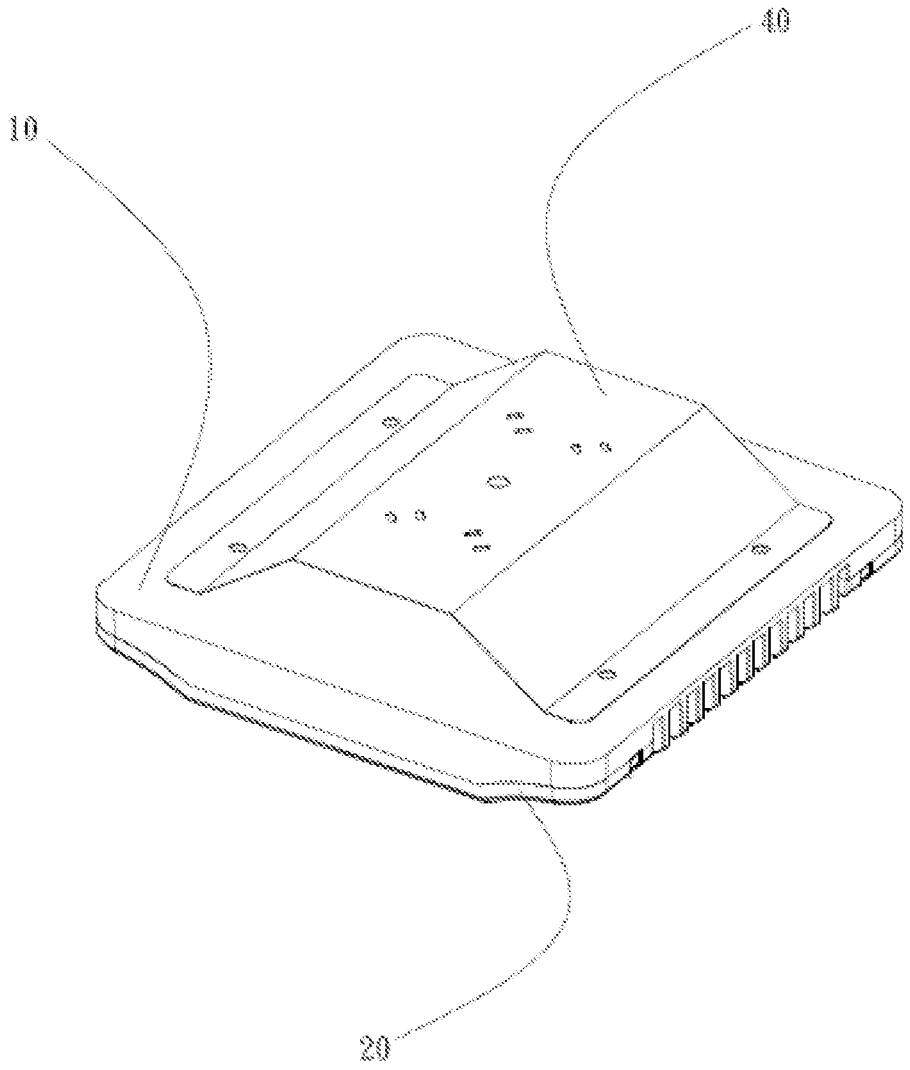
FIG. 1 is a perspective view of a light according to an embodiment.
Figure 2:
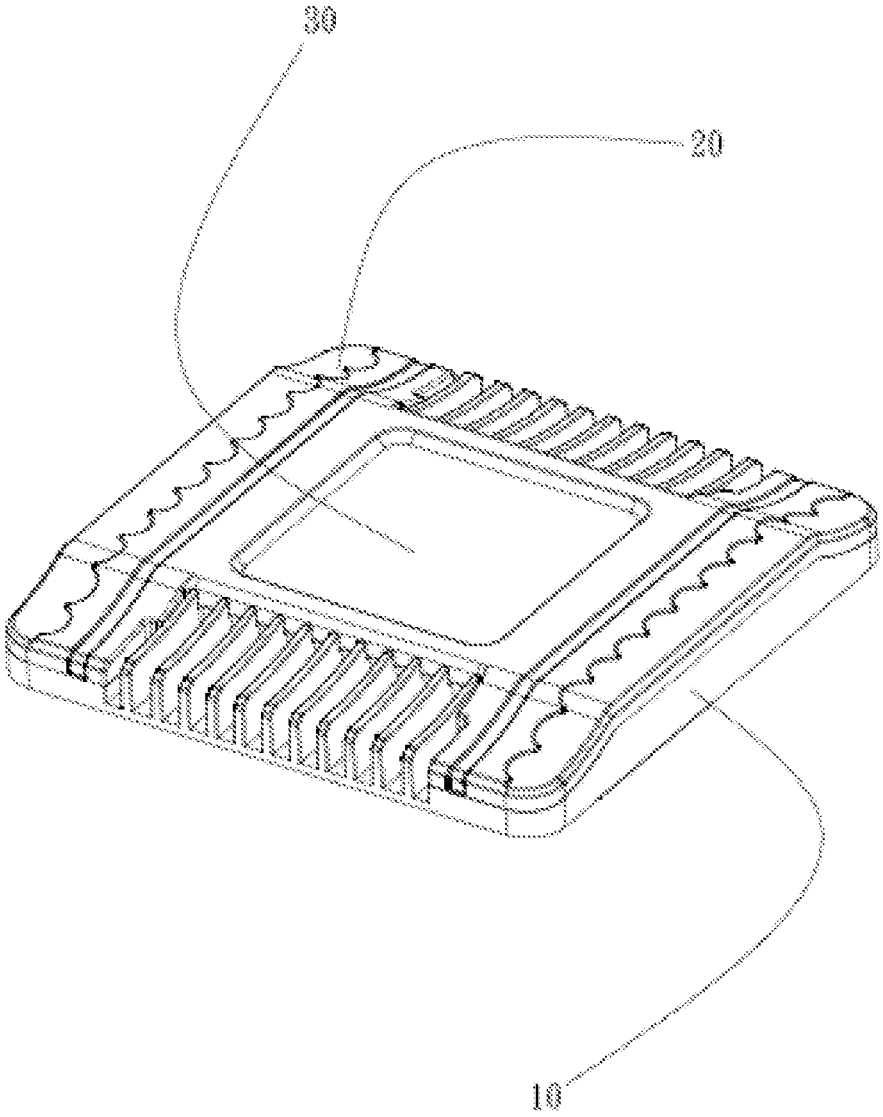
FIG. 2 is another perspective view of the light in FIG. 1.
Figure 3:
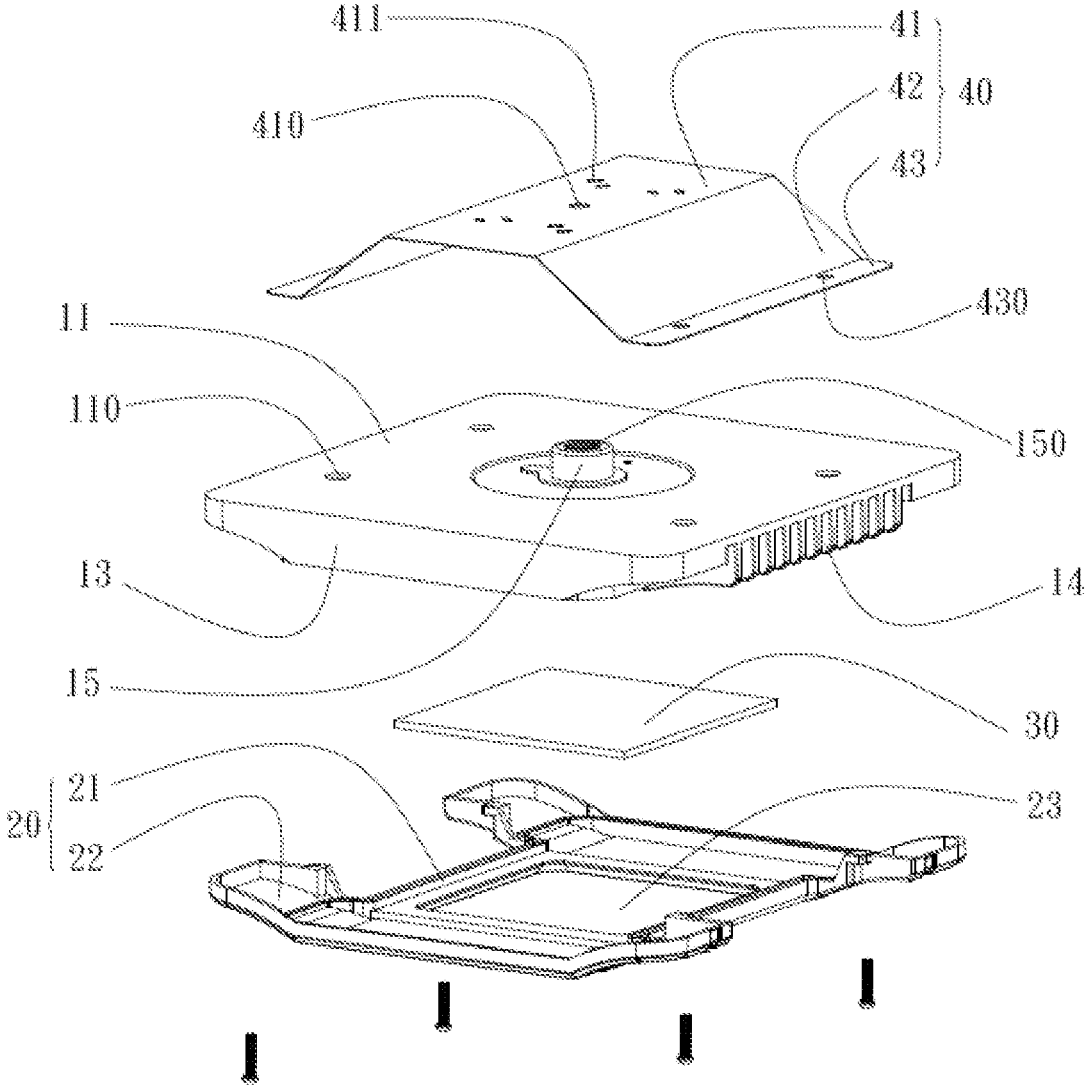
FIG. 3 is an exploded view of the light in FIG. 1.
Figure 4:
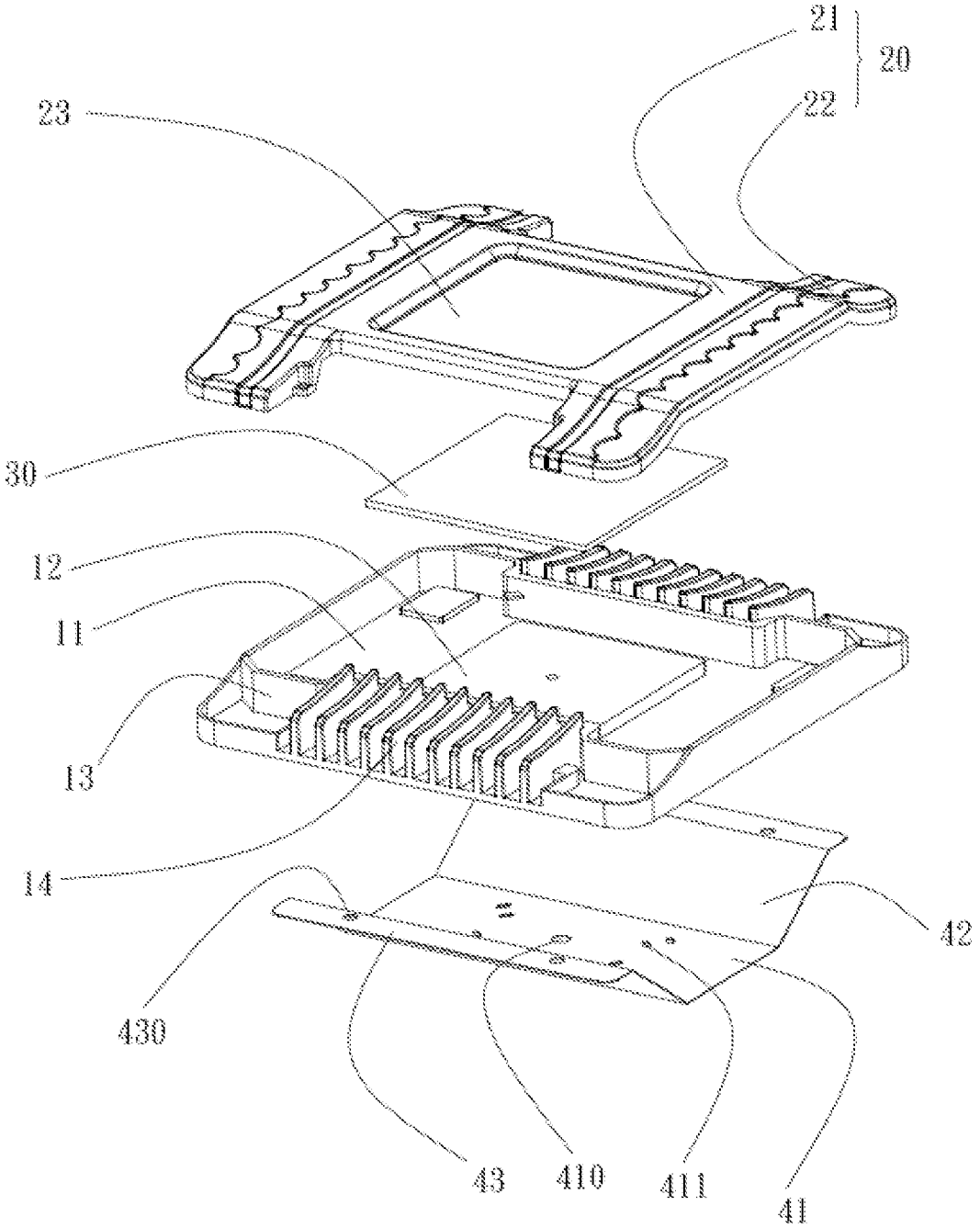
FIG. 4 is another exploded view of the light in FIG. 1.

Please refer to FIGS. 1-4, a light in accordance to an embodiment of the present disclosure is shown, which is to provide illumination and can be installed under the roof ceiling or on a hanging rod. The light includes a bottom box 10, a cover 20 mounted on the bottom box 10, a light emitting shield 30 mounted on the cover 20 and a back plate 40; the back plate 40 can be removed from the light; after the back plate 40 is being removed, the light can be mounted onto the roof ceiling or the hanging rod via the bottom box 10; after the back plate 40 is being mounted to the bottom box 10, the light can be mounted to the roof ceiling or the hanging rod through the back plate 40.

The bottom box 10 includes a bottom plate 11, a light source 12 connecting to the bottom plate 11, a sealing strip 13 extending from the surface of the bottom plate 11, a plurality of cooling fins 14 connected to the bottom plate 11 and a rod sleeve 15 connecting the bottom plate 11; a plurality of connection holes 110 are configured in the bottom plate 11; the light source 12 is mounted in the central of the bottom plate 11; the sealing strip 13 extends perpendicularly from the surface of the bottom plate 11; the plurality of cooling fins 14 are distributed on the two ends of the surface of the bottom plate 11; the rod sleeve 15 is positioned in the central of the rear surface of the bottom box 10; the rod sleeve 15 is provided with a mounting hole 150 thereon for a hanging rod; and the rod sleeve 15 is provided with screw threads on the inner side of the mounting hole.

The cover 20 includes a main cover 21 and a sealing portion 22 extending from the four corners of the main cover 21; the main cover 21 is provided with a light transmitting opening 23; the position of the light transmitting opening 23 is corresponding to the light source 12; the edges of the main cover 21 and the sealing portion 22 are firmly attached to the edge of the sealing strip 13.

The light emitting shield 30 is fixed in the light transmitting opening 23.

The back plate 40 includes a mounting portion 41, two extending portions 42 extending from both sides of the mounting portion 41 and two fixing portions 43 extending from the extending portions 42; the mounting portion 41 of the back plate 40 is provided with a rod receiving hole 410 therein; the mounting portion 41 of the back plate 40 is provided with a plurality of plate connection holes 411 therein; the fixing portion of the back plate is provided with a plurality of fixing holes 430 therein. The extending portions 42 extends from a side of the mounting portion 41 and in a direction forming an angle to the plane of the mounting portion 41; the fixing portion 43 extends horizontally from an end of the extending portions 42; the fixing portion 43 of the back plate 40 is provided with a plurality of fixing holes 430; the fixing holes 430 of the fixing portion 43 are configured corresponding to the connection holes 110 of the bottom plate 11.

The light, after assembly, the edge of the main cover 21 of the cover 20 fits with the edge of the sealing strip 13; the light, after assembly, the edge of the sealing portion 22 of the cover 20 fit with the edge of the sealing strip; through the docking of the cover 20 to the sealing strip 13 of the bottom box 10, the light is provided with a preferable waterproofness.

In one embodiment, it is needed to mount the light reliably on the ceiling; in such a scenario, the back plate 40 is removed from the light, and a mounting hole corresponding to the position of the connection hole 110 can be configured in the ceiling, so that through a connection member and the connection hole 110 in the bottom plate 11, the light can be mounted to the ceiling via the connection member; in one embodiment, the connection member is a screw.

In one embodiment, the light cannot be mounted in a corresponding scenario through the bottom plate 11 directly, such as when a surface to be mounted on is a limited area; in such a case, the back plate 40 will be removed first, the back plate 40 will be mounted to the mounting surface via the plate connection holes 411 in the mounting portion 41 of the back plate 40, next, by a connection member threading the connection hole 110 in the bottom plate 11 and the fixing hole 430 in the back plate 40, the bottom box 10 is mounted to the fixing portion 43 of the back plate 40, thereby the installation of the light is implemented.

In one embodiment, the light is required to be mounted to a hanging rod with a screw thread at the end; in such a scenario, the back plate 40 will be removed from the light, after completing the electrical connection of the light, the light will be screwed to the screw end of the hanging rod via the mounting hole 150 of the rod sleeve 15 for a hanging rod, thereby the installation of the light is implemented.

In one embodiment, the light cannot be directly screwed to the hanging rod with a screw thread at the end, such as the light is not provided with sufficient space to be screwed to the hanging rod; in such a scenario, the back plate 40 will be removed from the light. And then, via a plurality of screw-threaded members, the back plate 40 is fixed to the screw-threaded end of the hanging rod. Next, through the connection holes 110 in the bottom plate 11 and the fixing holes 430, the bottom box 10 is mounted to the fixing portion 43 of the back plate 40, thereby the installation of the light is implemented; in one of the ways of installation, a screw nut is first being screwed into the screw-threaded end of the hanging rod, then via the rod receiving hole 410 of the mounting portion 41 of the back plate 40, the mounting portion 41 is sleeved into the screw-threaded end of the hanger, thereafter, a second screw nut is first screwed into the screw-threaded end of the hanging rod, so that the back plate 40 is fixed to the screw-threaded end of the hanging rod, the bottom box 10 is later mounted to the back plate 40.

The light in the present disclosure, by providing a rod sleeve 15 with screw thread and a back plate 40 with rod receiving hole 410 and plate connection hole 411, allows the light to be installed through multiple ways and enables the light to be adaptable to different installation conditions, thereby increasing the universality of the light.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A light configured to provide illumination, comprising:
a bottom box;
a cover mounted on the bottom box;
a light emitting shield mounted on the cover; and
an optional back plate that can be removed from the light;
wherein the bottom box comprises a bottom plate, a light source connected to the bottom plate, a sealing strip extending from the bottom plate, a plurality of cooling fins connected to the bottom plate, and a rod sleeve connecting the bottom plate;
wherein the bottom plate is provided with a plurality of connection holes thereon;
wherein the optional back plate comprises a mounting portion having a surface smaller than that of the bottom plate, two extending portions extending from both sides of the mounting portion, and two fixing portions extending from the extending portions; the mounting portion is provided with a rod receiving hole thereon; the mounting portion is provided with a plurality of plate connection holes thereon; the fixing portion is provided with a plurality of fixing holes thereon corresponding to the connection holes, and
wherein the optional back plate is employed when a mounting surface is too small for the bottom plate of the light.

2. The light of claim 1, wherein the plurality of cooling fins are distributed on two ends of a surface of the bottom plate.

3. The light of claim 1, wherein the light source is mounted in a center of the bottom plate.

4. The light of claim 1, wherein the sealing strip extends perpendicularly from a surface of the bottom plate.

5. The light of claim 1, wherein the cover comprises a main cover and a sealing portion; the main cover has a light transmitting opening corresponding to the light source; edges of the main cover and the sealing portion are firmly attached to an edge of the sealing strip.

6. The light of claim 5, wherein the light emitting shield is fixed in the light transmitting opening.

7. The light of claim 1, wherein the rod sleeve is positioned in a central of a rear surface of the bottom box; the rod sleeve is provided with a mounting hole thereon for a hanging rod; and the rod sleeve is provided with screw threads on an inner side of the mounting hole.

8. The light of claim 1, wherein the fixing hole of the fixing portion is corresponding to the connection hole in the bottom plate.

9. The light of claim 1, wherein the extending portions extends from a side of the mounting portion and form an angle with a plane of the mounting portion.

10. The light of claim 9, wherein the fixing portion extends horizontally from an end of the extending portions.

* * * * *